US009434576B2

(12) United States Patent
Saarelainen et al.

(10) Patent No.: US 9,434,576 B2
(45) Date of Patent: Sep. 6, 2016

(54) BACKUP CIRCUIT FOR ELECTRICITY SUPPLY, ELEVATOR SYSTEM, AND METHOD FOR ENSURING ELECTRICITY SUPPLY OF AN ELECTRONIC OVERSPEED GOVERNOR

(71) Applicant: KONE CORPORATION, Helsinki (FI)

(72) Inventors: Antti Saarelainen, Espoo (FI); Ari Kattainen, Hyvinkää (FI); Ari Ketonen, Helsinki (FI)

(73) Assignee: Kone Corporation, Helsinki (FI)

( * ) Notice: Subject to any disclaimer, the term of this patent is extended or adjusted under 35 U.S.C. 154(b) by 511 days.

(21) Appl. No.: 13/886,941

(22) Filed: May 3, 2013

(65) Prior Publication Data

US 2013/0240301 A1 Sep. 19, 2013

Related U.S. Application Data

(63) Continuation of application No. PCT/FI2011/000044, filed on Nov. 2, 2011.

(30) Foreign Application Priority Data

Nov. 18, 2010 (FI) ..... 20106215

(51) Int. Cl.
*B66B 1/06* (2006.01)
*B66B 1/34* (2006.01)
*B66B 5/06* (2006.01)

(52) U.S. Cl.
CPC .. *B66B 1/34* (2013.01); *B66B 5/06* (2013.01)

(58) Field of Classification Search
CPC ..... B66B 1/34; B66B 5/06
USPC ..... 187/247, 277, 290, 293, 391, 393; 307/64, 66
See application file for complete search history.

(56) References Cited

U.S. PATENT DOCUMENTS 4,316,097 A * 2/1982 Reynolds ..... B66B 5/02 187/290
5,058,710 A * 10/1991 Iwasa ..... B66B 5/02 187/290
5,693,919 A * 12/1997 Sager ..... B66B 5/027 187/282
5,893,432 A * 4/1999 Nguyen ..... B66B 5/02 187/290
6,196,355 B1 * 3/2001 Fargo ..... B66B 3/00 187/287
6,315,081 B1 11/2001 Yeo (Continued)

FOREIGN PATENT DOCUMENTS

EP 0 708 051 A1 4/1966
EP 1 731 470 A1 12/2006

(Continued)

*Primary Examiner* — Anthony Salata
(74) *Attorney, Agent, or Firm* — Birch, Stewart, Kolasch & Birch, LLP

(57) ABSTRACT

A backup circuit for supplying electricity to an electronic overspeed governor in connection with a malfunction of a main electricity supply is disclosed. The backup circuit includes an energy storage. The backup circuit is configured to disconnect the supply of electricity from the energy storage to the electronic overspeed governor with a delay when the malfunction of the main electricity supply is detected, and when the malfunction of the main electricity supply continues for a predetermined amount of time, restarting the supply of electricity from the energy storage to the electronic overspeed governor.

10 Claims, 4 Drawing Sheets

(56) References Cited

U.S. PATENT DOCUMENTS 6,460,658 B2 * 10/2002 Suga ..... B66B 1/30 187/290
6,827,182 B2 * 12/2004 Araki ..... B66B 5/027 187/290
7,275,622 B2 * 10/2007 Hall ..... B66B 5/02 187/277
7,614,481 B2 * 11/2009 Okamoto ..... B66B 5/06 187/290
8,146,714 B2 * 4/2012 Blasko ..... B66B 1/30 187/290
8,230,978 B2 * 7/2012 Agirman ..... B66B 5/027 187/290
2005/0006182 A1 1/2005 Hall et al.
2014/0209415 A1 * 7/2014 Hall ..... B66B 5/027 187/290

FOREIGN PATENT DOCUMENTS

GB 1 469 576 4/1977
WO WO 00/39015 A1 7/2000
WO WO 2005/066058 A2 7/2005
WO WO 2007/020325 A2 2/2007

* cited by examiner

BACKUP CIRCUIT FOR ELECTRICITY SUPPLY, ELEVATOR SYSTEM, AND METHOD FOR ENSURING ELECTRICITY SUPPLY OF AN ELECTRONIC OVERSPEED GOVERNOR

CROSS REFERENCE TO RELATED APPLICATIONS

This application is a Bypass Continuation of PCT International Application No. PCT/FI2011/000044 filed on Nov. 2, 2011, which claims priority under 35 U.S.C §119(a) to patent application Ser. No. 20106215 filed in Finland on Nov. 18, 2010, all of which are hereby expressly incorporated by reference into the present application.

FIELD OF THE INVENTION

The invention relates to solutions for ensuring the electricity supply of an electronic overspeed governor.

BACKGROUND OF THE INVENTION

An overspeed governor is normally used for monitoring unintended movement of an elevator car. The overspeed governor activates a safety gear preventing movement of the elevator car, if the speed grows of the elevator car becomes too high. The overspeed governor is connected to the safety gear with a rope, which passes via the rope pulley of the overspeed governor. The rope pulley of the overspeed governor is normally able to rotate freely when the elevator car is moving. The overspeed governor activates the safety gear by stopping the movement of the rope of the safety gear. In practice, this occurs by locking the movement of the rope pulley of the overspeed governor with a locking means of the rope pulley, if the speed of the elevator car becomes too high. The locking means shifts from a position permitting movement of the rope pulley into a position preventing movement of the rope pulley from the effect of centrifugal force.

An electronic overspeed governor is also proposed for monitoring unintended movement of an elevator car. An electronic overspeed governor comprises a microprocessor control, so that it enables more versatile monitoring of the movement of an elevator car than before. A number of values can be set for the limit value for the maximum permitted speed of the elevator car and the values can also be changed as a function of the position of the elevator car e.g. such that the limit value for the maximum permitted speed decreases when the elevator car approaches the end of the elevator hoistway. Publication U.S. Pat. No. 6,170,614 B1 presents the operating principle of one electronic overspeed governor.

Despite their obvious advantages electronic overspeed governors have not yet, however, displaced conventional mechanically-controlled overspeed governors to any significant extent in the safety arrangements of elevators. Conventional mechanically-controlled overspeed governors have retained their position owing to inter alia their simplicity, operational reliability and reliable structure.

An electronic overspeed governor also functions as an elevator safety device that is required by elevator regulations. For this reason an overspeed governor must be designed to be fail-safe such that a malfunction in the overspeed governor, e.g. a disturbance of the electricity supply of the overspeed governor, always results in the gripping of a moving elevator car.

One problem related to an electronic overspeed governor is how to ensure the operation of the overspeed governor in connection with an electricity outage. An elevator car must be able to be moved e.g. in an emergency braking situation and/or in an emergency rescue situation regardless of an electricity outage. Earlier this problem has been solved by using an accumulator of sufficiently large charge capacity as a reserve power source of the overspeed governor, which accumulator supplies current to the overspeed governor during an electricity outage. A drawback in this solution is the unpredictability of the timing of the emergency rescue, especially if the electricity outage affects a large city or large part of a city. If the accumulators have emptied there is nothing to indicate the operating condition of the electronic overspeed governor to the rescue personnel. In this case, when trying to move the elevator car by opening the machinery brakes the safety gear stops any movement of the elevator car.

AIM OF THE INVENTION

One object of the invention is to disclose a more reliable solution than prior art to the problem of ensuring the electricity supply of an electronic overspeed governor in connection with a malfunction of a main electricity supply. To achieve this aim the invention discloses a backup circuit for electricity supply comprises an energy storage wherein the backup circuit is configured to disconnect the supply of electricity from the energy storage to the electronic overspeed governor with a delay when the malfunction of the main electricity supply is detected, and when the malfunction of the main electricity supply continues for a predeteimined amount of time, restarting the supply of el energy storage to the electronic overspeed governor, an elevator system which includes the above-mentioned backup circuit, and also a method for supplying electricity to an electronic overspeed governor in connection with a malfunction of a main electricity supply. Some inventive embodiments and inventive combinations of the various embodiments are also presented in the descriptive section and in the drawings of the present application.

SUMMARY OF THE INVENTION

The backup circuit for electricity supply according to the invention for ensuring the electricity supply of an electronic overspeed governor in connection with a malfunction of the electricity supply comprises an energy storage for supplying electricity to the overspeed governor. The backup circuit for electricity supply is configured to disconnect the electricity supply from the energy storage ensuring the electricity supply of the electronic overspeed governor to the overspeed governor up until the disconnection of the electricity supply while the malfunction of the electricity supply continues. In a preferred embodiment of the invention the overspeed governor is therefore preferably fail-safe so that the overspeed governor is fitted to activate the gripping function when the electricity supply to the overspeed governor is disturbed. In a preferred embodiment of the invention the backup circuit for electricity supply is further configured to restart the electricity supply occurring from the energy storage to the overspeed governor when the malfunction of the electricity supply continues. In a preferred embodiment of the invention the backup circuit for electricity supply is configured to start the electricity supply occurring from the energy storage to the overspeed governor for the purpose of emergency drive of the elevator. The backup circuit for electricity supply preferably comprises a controllable switch for disconnecting the electricity supply occurring from the energy storage to the overspeed governor and/or for restarting said electricity supply. The invention enables the preserving of the charge of the energy storage that is in the backup circuit for the electricity supply of an electronic overspeed governor during a malfunction of the electricity supply, almost irrespectively of the duration time of the malfunction.

In a preferred embodiment of the invention the backup circuit for electricity supply is configured to disconnect the electricity supply from the energy storage ensuring the electricity supply of the electronic overspeed governor to the overspeed governor with a delay when a malfunction of the electricity supply is detected. The aforementioned disconnection delay of the electricity supply is preferably determined on the basis of the stopping delay of an apparatus monitored by the overspeed governor, preferably on the basis of the stopping delay of the elevator car and/or of the counterweight. When the electricity supply to the overspeed governor is disconnected only after the stopping of the elevator car /counterweight, the gripping of the elevator car/counterweight owing to disconnection of the electricity supply of the overspeed governor can be prevented.

In one embodiment of the invention the backup circuit for electricity supply is configured to receive a control signal for starting the electricity supply occurring from the energy storage to the overspeed governor. In this case the electricity supply to the overspeed governor can be started in a controlled manner e.g. in connection with a service drive procedure and/or an emergency drive procedure of the elevator. In one embodiment of the invention a control signal for starting the electricity supply occurring from the energy storage to the overspeed governor is sent from the emergency drive unit of the elevator to the overspeed governor. In one embodiment of the invention a control signal for starting the electricity supply occurring from the energy storage to the overspeed governor is sent from the service center for the elevators to the overspeed governor; in this case the aforementioned emergency drive/servicing procedure requiring the starting of the electricity supply of the overspeed governor can also be started and/or executed by remote control from the service center.

The invention also relates to a backup circuit for electricity supply for ensuring the electricity supply of an electronic overspeed governor in connection with a malfunction of the electricity supply, which backup circuit for electricity supply comprises an energy storage, and which backup circuit for electricity supply is provided with signaling means for indicating the state of charge of the aforementioned energy storage. In this case the rescue personnel are able, by means of the signaling means, to ascertain the state of charge of the energy storage before the elevator car is moved, in which case it is not futilely endeavored to move the elevator car before there is sufficient charge in the energy storage to prevent gripping of the elevator car in connection with a rescue procedure.

The elevator system according to the invention comprises an electronic overspeed governor for preventing unintended movement of an elevator car and/or of a counterweight. The elevator system comprises a backup circuit for electricity supply, according to any of those presented in the preceding, for ensuring the electricity supply of an overspeed governor in connection with a malfunction of the electricity supply of the elevator system. The invention is suited to elevator systems with counterweights and to elevator systems without counterweights, said elevator systems being intended e.g. for the transportation of passengers and/or freight.

In the method according to the invention for ensuring the electricity supply of an electronic overspeed governor, electricity is supplied from an energy storage to the electronic overspeed governor in connection with a malfunction of the electricity supply, and also the electricity supply from the energy storage ensuring the electricity supply of the electronic overspeed governor to the overspeed governor is disconnected while the malfunction of the electricity supply continues. In a preferred embodiment of the invention the electricity supply occurring from the energy storage to the overspeed governor is further re-started when the malfunction of the electricity supply continues.

Taking into account what is presented above, the invention also relates to an electronic overspeed governor, which comprises an interface to an energy storage for ensuring the electricity supply of an overspeed governor. The electronic overspeed governor is configured to disconnect the electricity supply from the energy storage ensuring the electricity supply of the electronic overspeed governor (3) to the overspeed governor up until the disconnection of the electricity supply while the malfunction of the electricity supply continues. The overspeed governor is preferably fitted to activate the gripping function when the electricity supply to the overspeed governor is disturbed.

The invention enables using an energy storage that is smaller in terms of its charge capacity than prior art for ensuring the electricity supply of an electronic overspeed governor e.g. in an elevator system. In this case the energy storage used, such as an accumulator, can also be smaller in size than prior art. According to the invention the backup circuit for the electricity supply of an electronic overspeed governor is also to a large extent independent of the duration of a malfunction of the electricity supply, which is important especially in the types of cases in which the time of servicing/rescue of the elevator is not known exactly and in which an electricity outage might also last a long time.

At the same time the invention also enables improvement of the reliability of servicing/rescue activities during a malfunction of the electricity supply and the fastest possible and trouble-free performance of servicing/rescue activities.

The aforementioned summary, as well as the additional features and advantages of the invention presented below, will be better understood by the aid of the following description of some embodiments, said description not limiting the scope of application of the invention.

BRIEF EXPLANATION OF THE FIGURES

In the following, the invention will be described in more detail by the aid of a few examples of its embodiments with reference to the attached drawings, wherein.

MORE DETAILED DESCRIPTION OF PREFERRED EMBODIMENTS OF THE INVENTION

Figure 1:
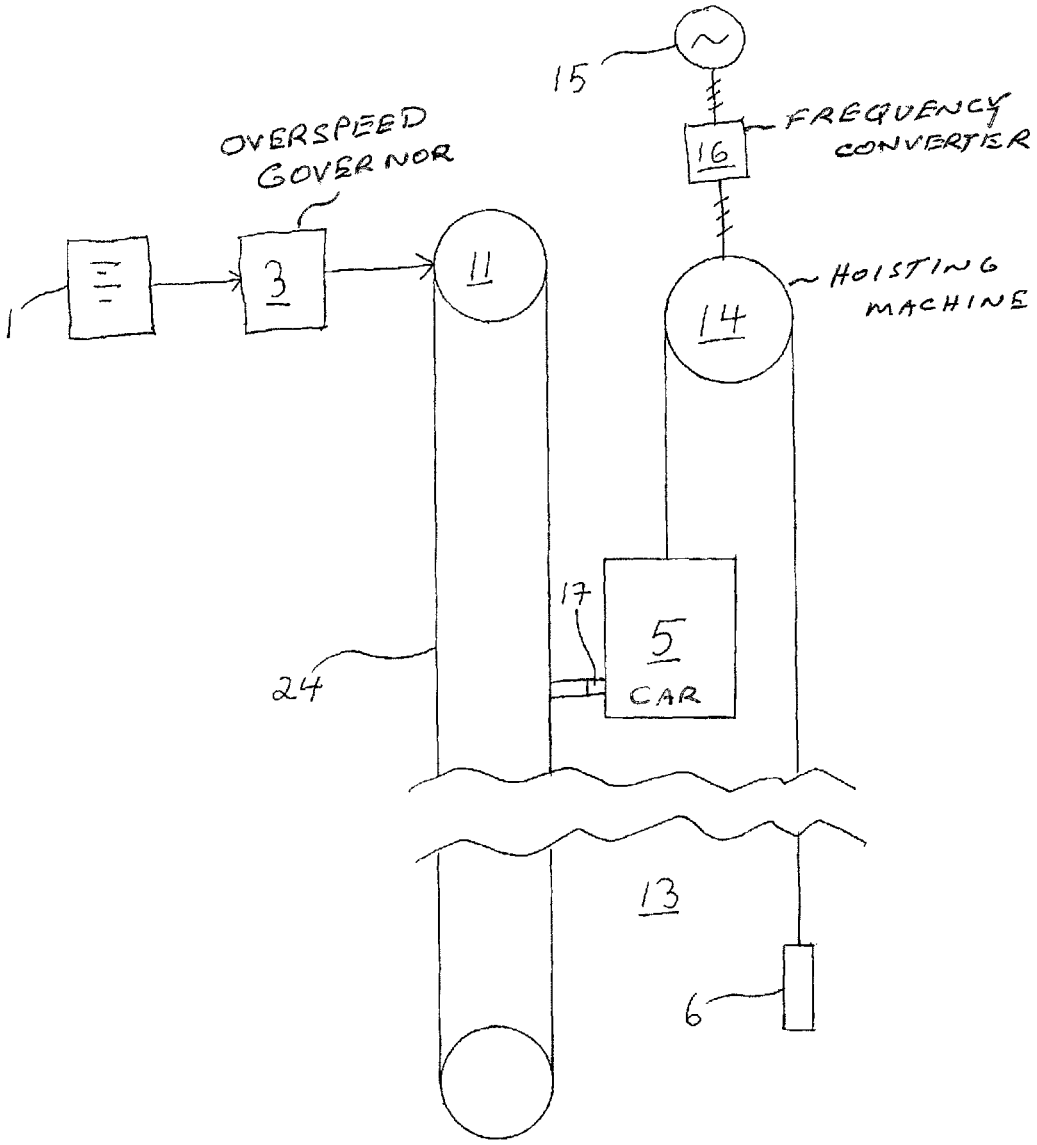
FIG. 1 presents as a block diagram an elevator system according to the invention

FIG. 1 presents as a block diagram an elevator system, in which the elevator car 5 and the counterweight 6 are suspended in the elevator hoistway 13 with elevator ropes, a belt or corresponding passing via the traction sheave of the hoisting machine 14. The torque that moves/supports the elevator car 5 is produced with the permanent-magnet synchronous motor of the hoisting machine 1. The power supply to the permanent-magnet synchronous motor occurs during normal operation from an electricity network 15 with a frequency converter 16. Current is supplied from the electricity network 15 also to other electrical/electronic devices of the elevator, when the electricity network 15 is in operating condition.

Figure 2:
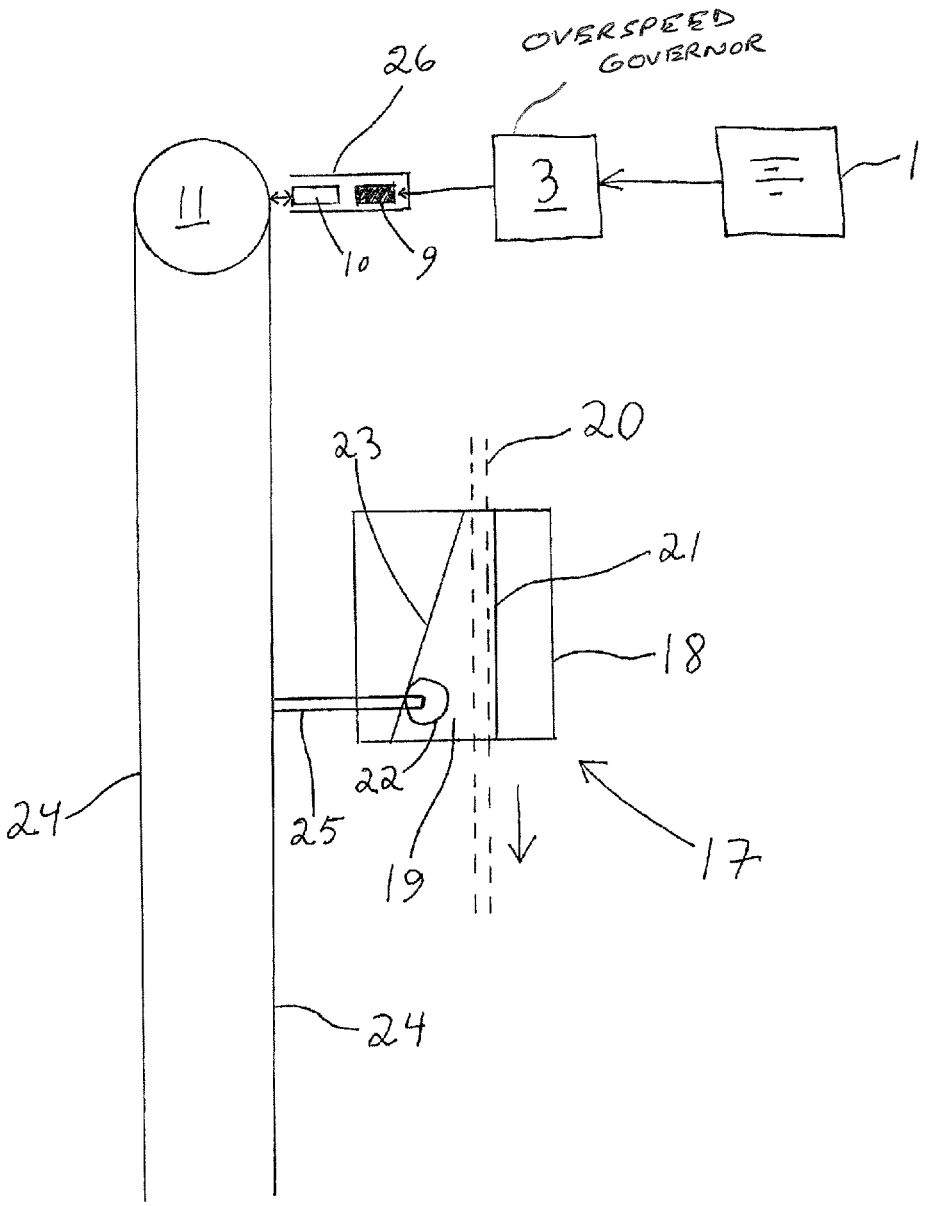
FIG. 2 illustrates the operation of an overspeed governor according to the invention

The elevator system of FIG. 1 comprises as a safety device a safety gear 17 of the elevator car, with which safety gear movement of the elevator car 5 is stopped in a dangerous situation, such as owing to adequately large overspeed of the elevator car 5, by gripping to a guide rail 20 (shown in FIG. 2) of the elevator car. In one embodiment of the invention the elevator system comprises as a safety device also a safety gear of the counterweight, with which safety gear movement of the counterweight 6 is stopped in a dangerous situation by gripping to the guide rail 20 of the counterweight. One operating principle of a possible safety gear 17 of an elevator car also suited to the elevator system of FIG. 1 is illustrated in FIG. 2. The frame part 18 of the safety gear 17 is fixed in connection with the elevator car 5 such that the frame part 18 moves along with the elevator car 5. The frame part 18 comprises a housing 19, which contains a braking surface 21 towards the elevator guide rail 20, and inside which housing 19 the elevator guide rail 20 is disposed. Likewise, the housing 19 comprises a roller 22, which when the safety gear 17 operates meets the elevator guide rail 20 and is disposed on a track 23 in the housing 19. The elevator guide rail 20 is between the braking surface 21 and the roller 22. The track 23 is shaped such that when the roller 22 moves on the track 23 in the direction of the guide rail 20, the guide rail 20 presses against the braking surface 21 under the effect of the roller 22 producing braking (gripping), which stops the elevator car 5. For example, the gripping of an elevator car 5 moving downwards in the direction of the arrow as presented in FIG. 2 starts when the transmission means 25 that is in connection with the rope pulley 11 of the overspeed governor of the elevator via the ropes 24 pulls the roller 22 along the track 23 upwards to grip the guide rail 20. In practice this occurs by locking the movement of the rope pulley 11 when the elevator car 5 moves downwards, in which case the movement of the roller 22 decelerates with respect to the track 23 moving along with the elevator car and the roller 22 moves along the track 23 into the gripping position.

An overspeed governor 3 measures the speed of the elevator car e.g. with an encoder fitted to the rope pulley 11 of the overspeed governor.

An electronic overspeed governor 3 activates the safety gear 17 by locking the movement of the rope pulley 11 of the overspeed governor with a solenoid 10. The solenoid 10 is movably supported on a frame part 26, and the frame part 26 is attached to a stationary part of the overspeed governor 3, so that movement of the rope pulley 11 is prevented by allowing the solenoid 10 to press onto the rope pulley 11. The solenoid comprises pushing means, such as pusher springs, which press the solenoid against the rope pulley 11. Detaching the solenoid 10 from the rope pulley 11, and keeping it detached from the rope pulley, requires that current is supplied to the coil 9 of the electromagnet of the solenoid, which current brings about an attractive force opposing the pushing force of the pushing means. An overspeed governor 3 is therefore fitted to activate the gripping function always when the current supply to the coil 9 of the electromagnet of the solenoid is disconnected. An overspeed governor 3 has been designed to be fail-safe such that the current supply to the coil 9 of the electromagnet of the solenoid disconnects and a moving elevator car 5 grips always in connection with a malfunction of the overspeed governor 3, e.g. when the electricity supply to the overspeed governor 3 malfunctions/disconnects.

Figure 3:
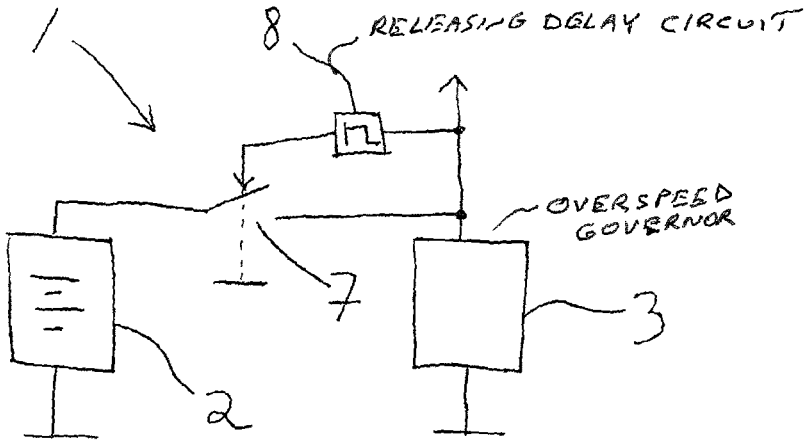
FIG. 3 presents as a circuit diagram a backup circuit for electricity supply according to the invention
Figure 4:
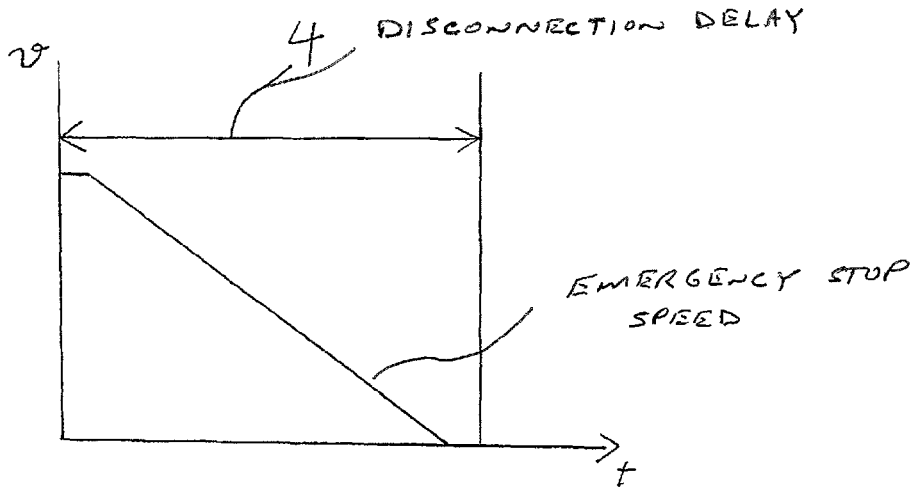
FIG. 4 illustrates the determination of the disconnection delay for the electricity supply of the overspeed governor in one embodiment of the invention

Since an elevator car must be able to be moved also in connection with an electricity outage—e.g. in an emergency braking situation and/or in an emergency rescue situation—the electricity supply of the overspeed governor must be ensured e.g. with an accumulator or corresponding. A problem is that the accumulator capacity needed, and therefore the size of the accumulator for the overspeed governor 3, may increase to be quite large. For this reason the electricity supply of the overspeed governor 3 in the embodiment of the invention according to FIG. 2 is ensured with a backup circuit 1 for electricity supply. The backup circuit 1 for electricity supply supplies electricity to the overspeed governor 3 e.g. during a malfunction of the electricity network 15/electricity outage. FIG. 3 presents in more detail a wiring diagram of a possible backup circuit for electricity supply suited e.g. to the embodiment of FIG. 2. In FIG. 3 the backup circuit 1 for electricity supply comprises an accumulator 2, e.g. a lead accumulator, a nickel-cadmium accumulator, a nickel-metal-hydride accumulator, a lithium-ion accumulator or a lithium-polymer accumulator. The positive voltage pole of the accumulator is connected to the positive supply pole 27 of the electronic overspeed governor 3 with a switch 7. The switch 7 is preferably a mechanical switch, such as a relay, but the use of a solid-state switch is also possible. The control of the switch 7 is arranged such that the switch opens and the electricity supply from the accumulator 2 to the overspeed governor 3 disconnects if a malfunction of the electricity network 15, such as electricity outage or a voltage reduction of the electricity network continues for a sufficiently long time. For this reason the backup circuit 1 for electricity supply comprises a releasing delay circuit 8, which forms a control signal for opening the switch 7 with a delay from the detected starting moment of the malfunction of the electricity network 15. In a preferred embodiment of the invention the switch 7 is a relay, the contact of which opens when the current supply to the control coil of the relay 7 disconnects, in which case the releasing delay circuit 8 disconnects the current supply to the control coil of the relay with a delay from the start of a malfunction of the electricity network 15. The control logic of the releasing delay circuit 8 can also be implemented by means of a program, e.g. in the software of the microprocessor of the overspeed governor 3. The aforementioned disconnection delay of the current supply is selected taking into account the movement of the elevator car in an emergency stop situation of the elevator. To illustrate this, FIG. 4 presents an emergency stop situation of an elevator, in which the machinery brakes of the hoisting machine of the elevator are activated to brake the movement of the traction sheave of the hoisting machine after a certain apparatus-dependent delay (e.g. approx. 100-500 milliseconds or more) from the start of a malfunction of the electricity network 15. When the machinery brakes are activated the speed v of the elevator car 5 starts to decelerate from its rated value, until the elevator car finally stops. The electronic overspeed governor 3 starts gripping of the elevator car 5 if the electricity supply to the electronic overspeed governor 3 disconnects when the elevator car 5 is still moving. For this reason the opening of the contact of the relay 7 is delayed with a time delay 4 such that the elevator car 5 has had time to stop before the contact of the relay 7 opens.

After the contact of the relay 7 has opened, the electricity supply from the accumulator 2 to the overspeed governor 3 is prevented while a malfunction of the electricity network 15 continues. In certain special situations the electricity supply occurring from the accumulator 2 to the overspeed governor 3 is re-started despite continuation of a malfunction of the electricity network 15, e.g. for transferring passengers remaining in the elevator car 5 to the nearest possible stopping floor of the elevator, either with emergency drive or, utilizing the force of gravity, by opening the machinery brakes of the hoisting machine. In one embodiment of the invention, more particularly in connection with an elevator system without machine room, the electricity supply from the accumulator 2 to the overspeed governor 3 starts when the cover of the emergency drive unit of the elevator is opened. In elevator systems without machine rooms the emergency drive unit is generally disposed in connection with an entrance to the elevator hoistway, but it can also be disposed in a machine room. The emergency drive unit is normally locked and it is opened only for the purpose of emergency drive, installation, maintenance, or other such special use of the elevator. The contact of the relay 7 of the backup circuit 1 for electricity supply is configured to close when opening the cover of the emergency drive unit of the elevator. Closing of the contact of the relay 7 can be implemented with positive closing e.g. such that the contact of the relay 7 is pressed closed e.g. from the effect of a spring when opening the cover of the emergency drive unit.

In one embodiment of the invention, more particularly in connection with an elevator system without machine room, the contact of the relay 7 disconnecting the electricity supply of the electronic overspeed governor 3 closes with positive closing by using a pushbutton in the machine room. The aforementioned pushbutton can be disposed e.g. in the emergency drive unit or elsewhere in the elevator control unit.

In a preferred embodiment of the invention the overspeed governor 3 forms a status signal, which indicates the operating condition, more particularly the state of charge of the accumulator 2, of the overspeed governor 3. The emergency drive unit/another elevator control unit comprises a signaling device, e.g. a green LED, which is controlled on the basis of the status signal of the overspeed governor 3. In this case the illumination of the green LED tells service personnel/rescue personnel that the accumulator 2 contains sufficient charge for detaching the solenoid 10 of the overspeed governor from the rope pulley 11, in which case the overspeed governor is operational and moving of the elevator car is possible in connection with a rescue procedure.

In the invention the term emergency braking situation refers to the stopping of the elevator car 5 by activating the machinery brakes of the hoisting machine 14 as well as by disconnecting the electricity supply to the elevator motor.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A backup circuit for supplying electricity to an electronic overspeed governor in connection with a malfunction of a main electricity supply, the backup circuit comprising:

an energy storage;

a switch provided between the energy storage and the electronic overspeed governor; and a releasing delay circuit which forms a control signal for opening the switch in order to disconnect the supply of electricity supply from the energy storage to the electronic overspseed governor with a delay when a malfunction of the main electricity supply is detected, wherein the disconnection delay for the electricity supply of the electronic overspeed governor is determined on the basis of a stopping delay of an a apparatus monitored by the electronic overspeed governor, and when the malfunction of the main electricity supply occurss, the switch of the backup circuit is configured to close for restarting the supply of electricity from the energy storage to the electronic overspeed governor.

2. The backup circuit according to claim 1, wherein the circuit is associated with an elevator, wherein the circuit is further configured to start the supply of electricity from the energy storage to the electronic overspeed governor for the purpose of emergency drive of the elevator.

3. The backup circuit according to claim 1 is further configured to receive, after a the malfunction occurs, a control signal for starting the supply of electricity from the energy storage to the electronic overspeed governor upon closing of the switch.

4. The backup circuit according to claim 1, wherein the electronic overspeed governor is fitted to activate a gripping function when the electricity supply to the overspeed governor is disturbed.

5. The backup circuit according to claim 1, further comprising a signaling means for indicating the state of charge of the energy storage.

6. The backup circuit according to claim 1 is further configured to receive, after a the malfunction occurs, a control signal for starting the supply of electricity from the energy storage to the electronic overspeed governor upon closing of the switch.

7. An elevator system comprising:

an electronic overspeed governor for preventing unintended movement of an elevator car and/or of a counterweight; and a backup circuit for supplying electricity to the electronic overspeed governor in connection with a malfunction of a main electricity supply, the backup circuit comprising:

an energy storage;

a switch provided between the energy storage and the electronic overspeed governor; and a releasing delay circuit which form a control signal for opening the switch in order to disconnect the supply of electricity supply from the energy storage to the electronic overspeed governor with a delay when a malfunction of the main electricity supply is detected, wherein the disconnection delay for the electricity supply of the electronic overspeed governor is determined on the basis of a stopping delay of an apparatus monitored by the electronic overspeed governor, and when the malfunction of the main electricity supply occurs, the switch of the backup circuit is configured to close for restarting the supply of electricity supply from the energy storage to the electronic overspeed governor.

8. The backup circuit according to claim 7 wherein the circuit is further configured to start the supply of electricity from the energy storage to the electronic overspeed governor for the purpose of emergency drive of the elevator.

9. A method for supplying electricity to an electronic overspeed governor in connection with a malfunction of a main electricity supply, comprising:

disconnecting the supply of electricity supply from an energy storage to the electronic overspeed governor with a delay when a malfunction of the main electricity supply is detected, wherein the disconnection delay for the electricity supply of the electronic overspeed governor is determined on the basis of a stopping delay of an apparatus monitored by the electronic overspeed governor, and when the malfunction of the main electricity supply occurs, restarting the supply of electricity supply from the energy storage to the electronic overspeed governor.

10. The method of claim 9 wherein the method is for supplying electricity to an overspeed governor of an elevator, further comprising restarting the supply of electricity from the energy storage to the electronic overspeed governor for the purpose of emergency drive of the elevator.

* * * * *